US010138893B2

(12) United States Patent
Uehara et al.

(10) Patent No.: US 10,138,893 B2
(45) Date of Patent: Nov. 27, 2018

(54) SINGLE SUCTION CENTRIFUGAL BLOWER

(71) Applicant: Panasonic Intellectual Property Management Co., Ltd., Osaka (JP)

(72) Inventors: Akimasa Uehara, Aichi (JP); Satoshi Ousaka, Aichi (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 324 days.

(21) Appl. No.: 14/779,001

(22) PCT Filed: Feb. 18, 2014

(86) PCT No.: PCT/JP2014/000813
§ 371 (c)(1),
(2) Date: Sep. 21, 2015

(87) PCT Pub. No.: WO2014/147952
PCT Pub. Date: Sep. 25, 2014

(65) Prior Publication Data

US 2016/0047386 A1 Feb. 18, 2016

(30) Foreign Application Priority Data

Mar. 21, 2013 (JP) ..... 2013-057618

(51) Int. Cl.
*F04D 17/16* (2006.01)
*F04D 25/08* (2006.01)
(Continued)

(52) U.S. Cl.
CPC ..... *F04D 17/16* (2013.01); *F04D 25/082* (2013.01); *F04D 29/4226* (2013.01);
(Continued)

(58) Field of Classification Search
CPC .... F04D 29/611; F04D 29/667; F04D 29/441; F04D 25/0606
(Continued)

(56) References Cited

U.S. PATENT DOCUMENTS 1,892,930 A * 1/1933 Burman ..... F04D 29/281 29/889.4
2,084,463 A * 6/1937 Stalker ..... F04D 29/441 292/327
(Continued)

FOREIGN PATENT DOCUMENTS

EP 1783374 A1 5/2007
GB 1408120 A 10/1975
(Continued)

OTHER PUBLICATIONS

English Translation of Chinese Search Report dated Feb. 15, 2017 for the related Chinese Patent Application No. 201480017125.3.
(Continued)

*Primary Examiner* — Jason Shanske
*Assistant Examiner* — Topaz L Elliott
(74) *Attorney, Agent, or Firm* — McDermott Will & Emery LLP

(57) ABSTRACT

A single suction type centrifugal fan includes a casing, an impeller, and a main plate. The casing includes a side plate and a motor fixing side plate, and the side plate and the motor fixing side plate are arranged in parallel. A rectifying plate is provided between the motor fixing side plate and the main plate, and the rectifying plate is formed from an inclined surface in which an area of a cross section orthogonal to a rotation shaft is reduced toward the impeller around the rotation shaft of a motor. A first rectifying plate diameter at another side of the rectifying plate closer to the impeller is smaller than an impeller diameter of the impeller.

8 Claims, 9 Drawing Sheets

(51) Int. Cl.
*F04D 29/66* (2006.01)
*F04D 29/44* (2006.01)
*F04D 29/42* (2006.01)

(52) U.S. Cl.
CPC ..... *F04D 29/441* (2013.01); *F04D 29/667* (2013.01); *F04D 29/422* (2013.01)

(58) Field of Classification Search
USPC ..... 415/206, 208.1, 213.1
See application file for complete search history.

(56) References Cited

U.S. PATENT DOCUMENTS 2,134,142 A * 10/1938 Orear ..... F24F 7/06 415/204
2,331,056 A * 10/1943 Spear ..... F04D 29/646 415/8
3,619,088 A * 11/1971 Bullock ..... F04D 29/282 415/180
4,065,233 A * 12/1977 Torigoe ..... F04D 25/082 415/208.3
4,245,965 A * 1/1981 Brown ..... F04D 17/04 415/124.2
4,890,547 A * 1/1990 Wagner ..... F04D 29/441 454/356
5,839,879 A * 11/1998 Kameoka ..... F04D 29/4233 415/206
6,575,701 B2 * 6/2003 Kamiya ..... B60H 1/00471 415/206
7,614,250 B2 * 11/2009 Sanagi ..... F04D 25/082 62/426
9,334,875 B2 * 5/2016 Sato ..... F04D 29/4226
2012/0045323 A1 * 2/2012 Kagawa ..... F04D 29/162 415/206
2013/0094954 A1 * 4/2013 Ishii ..... F04D 25/082 415/206
2013/0121818 A1 5/2013 Shichiken et al.
2017/0096079 A1 * 4/2017 Yokote ..... H01M 10/625

FOREIGN PATENT DOCUMENTS

JP 07-167087 A 7/1995
JP 11-062896 A 3/1999
JP 11062896 A * 3/1999
JP 2000050602 A * 2/2000
JP 2001-221197 A 8/2001
JP 2004-084602 A 3/2004
JP 2006-083772 A 3/2006
WO 2011/148578 A1 12/2011

OTHER PUBLICATIONS

English Translation of Chinese Search Report dated Jul. 29, 2016 for the related Chinese Patent Application No. 201480017125.3.
International Search Report dated May 20, 2014 issued in International Patent Application No. PCT/JP2014/00813 (English translation thereof).

* cited by examiner

SINGLE SUCTION CENTRIFUGAL BLOWER

RELATED APPLICATIONS

This application is the U.S. National Phase under 35 U.S.C. § 371 of International Application No. PCT/JP2014/000813, filed on Feb. 18, 2014 which in turn claims the benefit of Japanese Patent Application No. 2013-057618 filed on Mar. 21, 2013, the disclosures of which applications are incorporated by reference herein.

TECHNICAL FIELD

The present invention relates to a single suction type centrifugal fan.

BACKGROUND ART

In a single suction type centrifugal fan including a scroll casing, an area of a flow passage cross section is gradually enlarged in a radial direction of an impeller from a tongue portion toward a rotating direction of the impeller. With a gas blown out from the impeller, a dynamic pressure is converted into a static pressure in the casing. In such a single suction type centrifugal fan, for downsizing of the casing, an enlargement direction of the area of the flow passage cross section is not the radial direction of the impeller but an axial direction of a motor.

Hereinafter, the above conventional single suction type centrifugal fan will be described with reference to FIGS. 5A and 5B. FIG. 5A is a side view of the conventional single suction type centrifugal fan, and FIG. 5B is a front view of the same single suction type centrifugal fan.

As shown in FIGS. 5A and 5B, single suction type centrifugal fan 101 includes casing 102, and impeller 103 built in casing 102. Casing 102 includes side plate 105 including suction port 104, scroll 106, and motor fixing side plate 108 to which motor 107 is fixed. Casing 102 is formed in a spiral shape in which an area of a flow passage cross section is gradually enlarged from tongue portion 109 toward rotating direction 110 of impeller 103. The area of the flow passage cross section is an area of a radial cross section in a region surrounded by an outer peripheral side of impeller 103, an inner side of scroll 106, side plate 105, and motor fixing side plate 108.

Impeller 103 is fixed to motor 107. When impeller 103 is rotated by drive of motor 107, suction air flow 111 flows into casing 102 from suction port 104 via impeller 103. A pressure of an air blown out from impeller 103 is boosted in spiral shape casing 102, the dynamic pressure is converted into a static pressure, and the air becomes discharge air flow 113 and flows out from discharge port 112.

In general single suction type centrifugal fan 116, an area of a flow passage cross section is enlarged in a radial direction of impeller 103 due to a shape of a scroll. However, in single suction type centrifugal fan 101 described in Patent Literature 1, motor fixing side plate 108 that enlarges the area of the flow passage cross section in a rotation shaft 114 direction of motor 107 (part of region A) is formed from tongue portion 109 toward rotating direction 110. It should be noted that in FIGS. 5A and 5B, an outer shape of general single suction type centrifugal fan 116 is also shown by broken lines.

That is, with single suction type centrifugal fan 101 of Patent Literature 1, with respect to general single suction type centrifugal fan 116, by ensuring a flow passage in the rotation shaft 114 direction, an enlargement rate in the radial direction is suppressed, so that a vertical size H and a lateral size Y of casing 102 are reduced. In a case of single suction type centrifugal fan 101, air flow 115 blown out into casing 102 from a side of a main plate of impeller 103 goes toward an outer peripheral side (side of scroll 106) and spreads to a side of motor fixing side plate 108. That is, air flow 115 smoothly flows into region A along a surface of scroll 106, so that an effect (conversion from the dynamic pressure into the static pressure) due to enlargement of the area of the flow passage cross section is obtained. The part enlarged in the rotation shaft 114 direction of motor 107 (region A) is a dead space where motor 107 protrudes from casing 102. This dead space is effectively utilized, so that downsizing of single suction type centrifugal fan 101 is realized. As a result, even in a case where the casing is downsized, a decrease in performance (static pressure) is suppressed.

CITATION LIST

Patent Literature

PTL 1: Unexamined Japanese Patent Publication No. 2006-83772

SUMMARY OF THE INVENTION

In such a conventional single suction type centrifugal fan 101, casing 102 can be downsized while suppressing the decrease in the performance (static pressure). However, since the enlarged part of the area of the flow passage cross section is formed in a spiral shape in the rotation shaft 114 direction of motor 107, a shape of motor fixing side plate 108 located closer to motor 107 is complicated. Such complicated shape motor fixing side plate 108 is not easily processed. In a case where casing 102 is formed by resin molding or the like, complicated shape motor fixing side plate 108 can be processed. However, in a case where an internal static pressure in particular is set to be high in single suction type centrifugal fan 101 and there is a need for forming casing 102 from a steel plate for ensuring strength of casing 102, the technique described in Patent Literature 1 is not easily applied. That is, in conventional single suction type centrifugal fan 101, casing 102 is not easily downsized while suppressing the decrease in the performance (static pressure) without complicating a shape of casing 102.

A single suction type centrifugal fan of the present invention includes a casing including a scroll, an impeller built in the casing, the impeller having a plurality of blades, and a main plate disposed between a motor and the impeller and fixed to a rotation shaft of the motor. The casing includes a side plate having a suction port, and a motor fixing side plate to which the motor is fixed. The side plate and the motor fixing side plate are arranged in parallel and the impeller is fixed to the motor. A rectifying plate surrounding the rotation shaft is provided between the motor fixing side plate and the main plate. The rectifying plate is formed from an inclined surface in which an area of a cross section orthogonal to the rotation shaft is reduced toward the impeller around the rotation shaft. A first rectifying plate diameter at one side of the rectifying plate closer to the impeller is smaller than an impeller diameter of the impeller.

In such a single suction type centrifugal fan, a gas blown out into the casing from the impeller smoothly flows into a ventilation passage part formed between the rectifying plate and the scroll along the scroll. The gas flowing into the ventilation passage part passes through the inclined surface in which the diameter is reduced from the motor fixing side plate, and becomes an air flow going toward the impeller while circling in the ventilation passage part. The air flow is abutted with the main plate located closer to the motor fixing side plate, and smoothly flows out to a discharge port along the main plate without contact with an air flow blown out into the casing from the impeller. Since the side plate and the motor fixing side plate are arranged in parallel, a size of the scroll in the same direction as a rotation shaft direction of the motor is fixed. Therefore, even when the casing is downsized, a shape of the motor fixing side plate, that is, a shape of the casing is not complicated, and a decrease in performance (static pressure) is suppressed.

DESCRIPTION OF EMBODIMENTS

Hereinafter, exemplary embodiments of the present invention will be described with reference to the drawings.

(First Exemplary Embodiment)

Figure 1A:
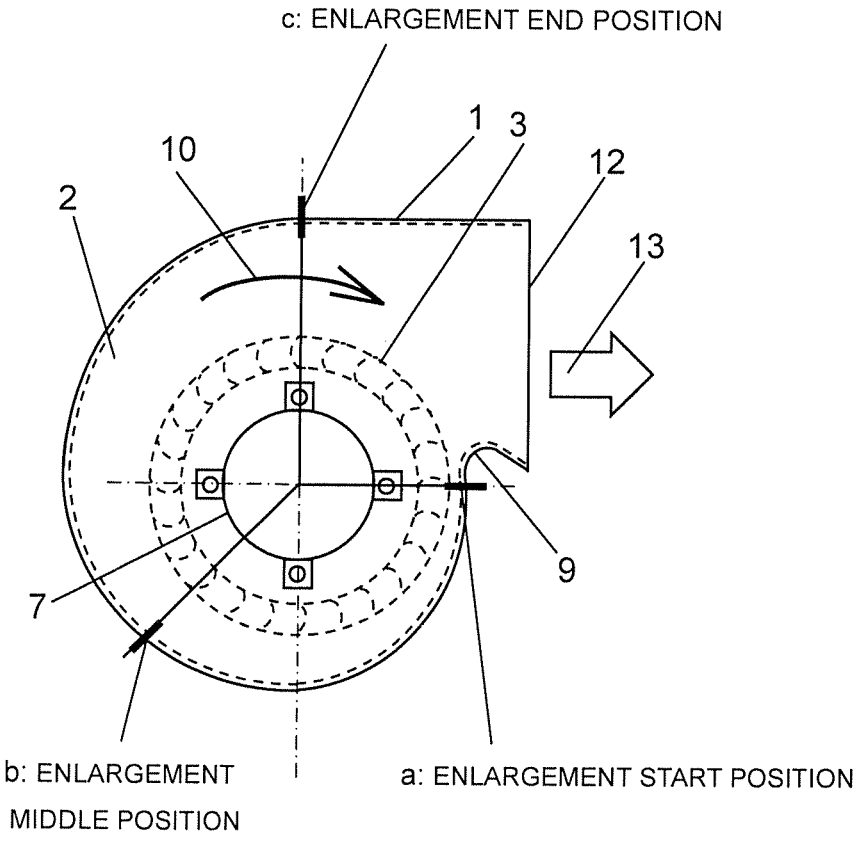
FIG. 1A is a side view of a single suction type centrifugal fan of a first exemplary embodiment of the present invention.
Figure 1B:
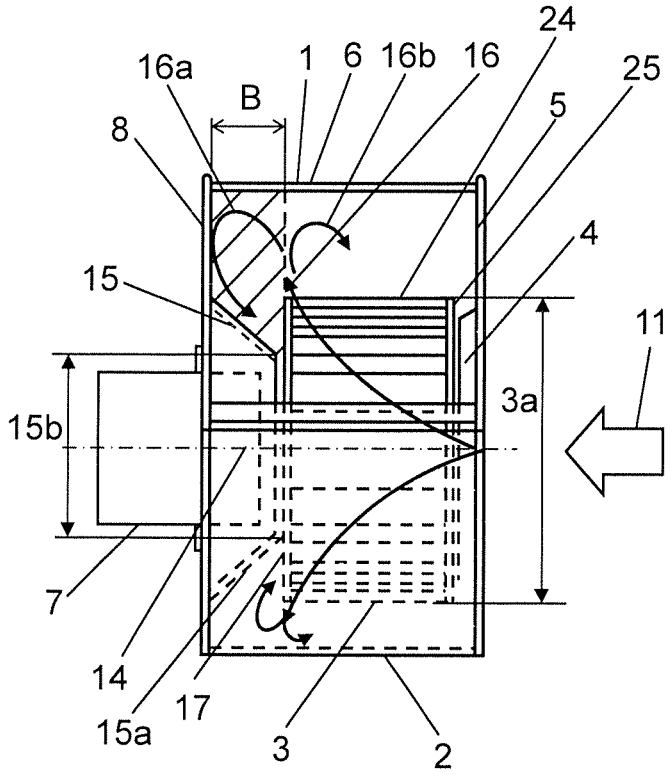
FIG. 1B is a front view of the same single suction type centrifugal fan.

FIG. 1A is a side view of a single suction type centrifugal fan of a first exemplary embodiment of the present invention, and FIG. 1B is a front view of the same single suction type centrifugal fan. As shown in FIGS. 1A and 1B, single suction type centrifugal fan 1 includes casing 2, impeller 3 built in casing 2, the impeller having a plurality of blades 24, and main plate 17 disposed between motor 7 and impeller 3 and fixed to rotation shaft 14 of motor 7. Casing 2 includes side plate 5 including suction port 4, scroll 6, and motor fixing side plate 8 to which motor 7 is fixed. Casing 2 is formed in a spiral shape in which an area of a flow passage cross section is gradually enlarged from tongue portion 9 toward rotating direction 10 of impeller 3. Impeller 3 is fixed to motor 7.

Impeller 3 includes main plate 17, plural pieces of blades 24, and auxiliary ring 25. The plural pieces of blades 24 are arranged on an outer peripheral side of main plate 17. Auxiliary ring 25 is fixed to front ends of blades 24 on an opposite side of end portions fixed to main plate 17. Auxiliary ring 25 has an open center part as the name suggests, and this opening serves as an impeller suction port that communicates with suction port 4. Main plate 17 is provided closer to motor 7 of blades 24.

When impeller 3 is rotated by drive of motor 7, suction air flow 11 flows into casing 2 from suction port 4 via impeller 3. A pressure of suction air flow 11 is boosted in spiral shape casing 2, the dynamic pressure is converted into a static pressure, and the suction air flow becomes discharge air flow 13 and flows out from discharge port 12.

Side plate 5 and motor fixing side plate 8 are arranged in substantially parallel. Rectifying plate 15 is provided between motor fixing side plate 8 and main plate 17 in casing 2 so as to surround rotation shaft 14 of motor 7. A surface of rectifying plate 15 orthogonal to rotation shaft 14 is a circle about rotation shaft 14. This circle of a cross section of rectifying plate 15 has a shape in which a diameter of the circle is reduced toward impeller 3, that is, an outer shape of rectifying plate 15 is a conical trapezoid shape. First rectifying plate diameter 15*b* at one side of rectifying plate 15 closer to impeller 3 is smaller than impeller diameter 3*a* of impeller 3. In such a way, rectifying plate 15 is formed from inclined surface 15*a* in which an area of the cross section orthogonal to rotation shaft 14 is reduced toward impeller 3 around rotation shaft 14. As shown in FIG. 1B, an entire body of impeller 3 is disposed at a side plate 5 side of rectifying plate 15.

Operations and effects of above single suction type centrifugal fan 1 will be described. By a ventilation passage part (region B) formed between rectifying plate 15 and scroll 6, the area of the flow passage cross section is enlarged not in a radial direction of the impeller 3 but in a rotation shaft 14 direction of motor 7.

Figure 2:
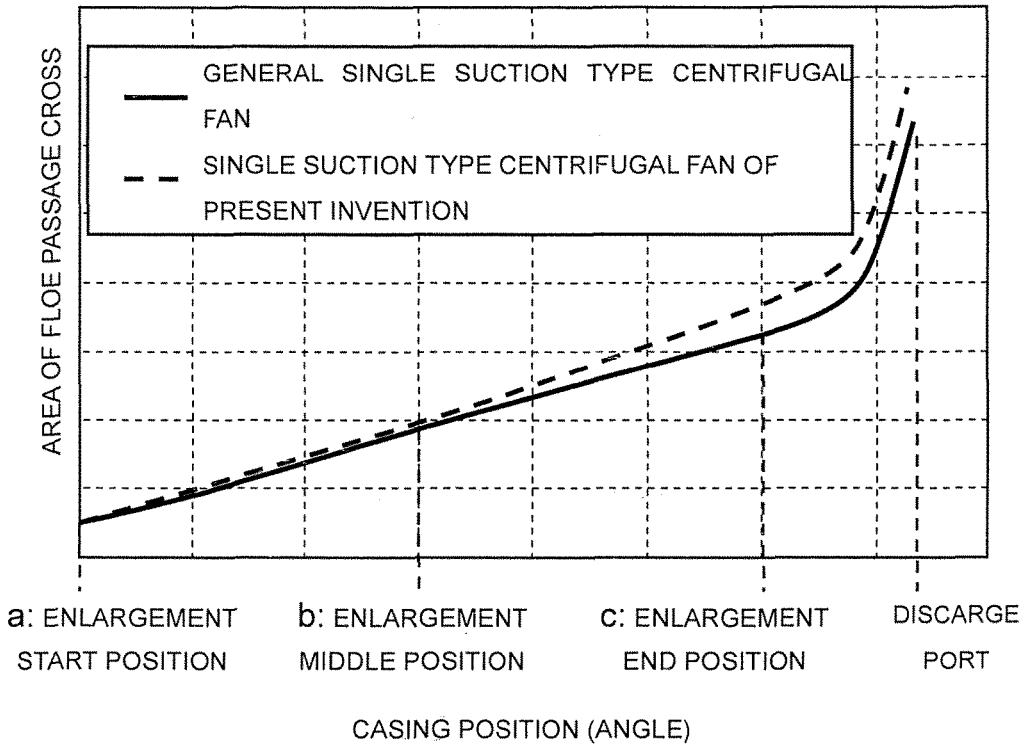
FIG. 2 is a graph for comparing changes in an area of a flow passage cross section between the same single suction type centrifugal fan and a general single suction type centrifugal fan.

FIG. 2 is a graph for comparing changes in an area of a flow passage cross section between the single suction type centrifugal fan of the first exemplary embodiment of the present invention and a general single suction type centrifugal fan. A vertical axis of FIG. 2 indicates the area of the flow passage cross section, and a horizontal axis indicates a position of the casing. As shown in FIG. 1A, regarding the position of casing 2, a position of tongue portion 9 is enlargement start position a, a part where an arc of scroll 6 ends is enlargement end position c, and a middle position between enlargement start position a and enlargement end position c is enlargement middle position b. In single suction type centrifugal fan 1, by suppressing an enlargement rate of a distance between scroll 6 and rotation shaft 14 of impeller 3, casing 2 is downsized. That is, in single suction type centrifugal fan 1 of the present invention, a ratio between the distance between rotation shaft 14 and scroll 6 at enlargement start position a of FIG. 1A and the distance between rotation shaft 14 and scroll 6 at enlargement end position c is smaller than that of the conventional and general single suction type centrifugal fan.

Meanwhile, regarding the area of the flow passage cross section in single suction type centrifugal fan 1 of the present invention of FIGS. 1A and 1B, casing 2 is enlarged in the rotation shaft 14 direction of motor 7, and the area of the flow passage cross section of the same area as in the conventional and general single suction type centrifugal fan is ensured from enlargement start position a to enlargement middle position b. In a part ranging from enlargement start position a to enlargement middle position b, a distance between impeller 3 and scroll 6 is smaller than that of the general single suction type centrifugal fan. However, in general, in the part ranging from enlargement start position a to enlargement middle position b, speed of an air flow blown out to casing 2 by impeller 3 is slowed down. Therefore, the air flow flows into the ventilation passage part (region B) formed between rectifying plate 15 and scroll 6 without contact with and turbulence by a surface of scroll 6.

From enlargement middle position b to enlargement end position c, single suction type centrifugal fan 1 has a larger area of the flow passage cross section than that of the general single suction type centrifugal fan. Therefore, in a case where an enlargement rate of the area of the flow passage cross section in the radial direction of impeller 3 is suppressed and hence casing 2 is downsized, and in a case where a winding angle (angle from enlargement start position a to enlargement end position c) of scroll 6 is reduced and hence casing 2 is downsized, the area of the flow passage cross section is also sufficiently enlarged.

In general, in the single suction type centrifugal fan, a gas flowing in from suction port 4 shown in FIG. 1B mostly flows to a side of main plate 17, and impeller 3 blows out a large amount of gas from the side of main plate 17. In single suction type centrifugal fan 1 of the first exemplary embodiment, an enlarged part of the area of the flow passage cross section is ensured on the side of main plate 17 (side of motor fixing side plate 8). Therefore, air flow 16 blown out into casing 2 from impeller 3 on the side of main plate 17 goes toward an outer peripheral side (side of scroll 6) and spreads to a side of motor fixing side plate 8.

Therefore, air flow 16 smoothly flows into the ventilation passage part (region B) formed between rectifying plate 15 and scroll 6 along the surface of scroll 6. Gas 16*a* flowing into the ventilation passage part (region B) goes toward impeller 3 while circling in the ventilation passage part (region B) along inclined surface 15*a* in which an outer diameter is reduced from motor fixing side plate 8. Air flow 16*a* flowing in region B is abutted with motor fixing side plate 8 in main plate 17 of impeller 3, and smoothly flows out to discharge port 12 along main plate 17 of impeller 3 without contact with air flow 16 or air flow 16*b* blown out into casing 2 from impeller 3.

Therefore, in single suction type centrifugal fan 1, turbulence of the air flow in casing 2 is suppressed, pressure losses are reduced, and turbulence noises generated by contact between air flows are also reduced. Thus, an effect due to enlargement of the area of the flow passage cross section (conversion from the dynamic pressure into the static pressure) is obtained.

Since side plate 5 and motor fixing side plate 8 are arranged in substantially parallel as shown in FIG. 1B, a size of scroll 6 in the same direction as the rotation shaft 14 direction of motor 7 is fixed. Therefore, a shape of motor fixing side plate 8 is not complicated, and the area of the flow passage cross section of casing 2 is enlarged in the rotation shaft 14 direction of motor 7.

It should be noted that in the first exemplary embodiment shown in FIG. 1B, an outer diameter size of rectifying plate 15 on the side of motor fixing side plate 8 is smaller than a distance from a center of impeller 3 to enlargement start position a, so that rectifying plate 15 and scroll 6 are not in contact with each other. However, the outer diameter size of rectifying plate 15 on the side of motor fixing side plate 8 may be increased, so that rectifying plate 15 and scroll 6 are brought into contact with each other. In that case, a part of rectifying plate 15 to be brought into contact with scroll 6 is cut out.

It should be noted that in the first exemplary embodiment, main plate 17 is a flat plate. However, a part of main plate 17 to be fixed to rotation shaft 14 may protrude to a side of auxiliary ring 25, and rectifying plate 15 located closer to impeller 3 may come into this protruding part.

Figure 3A:
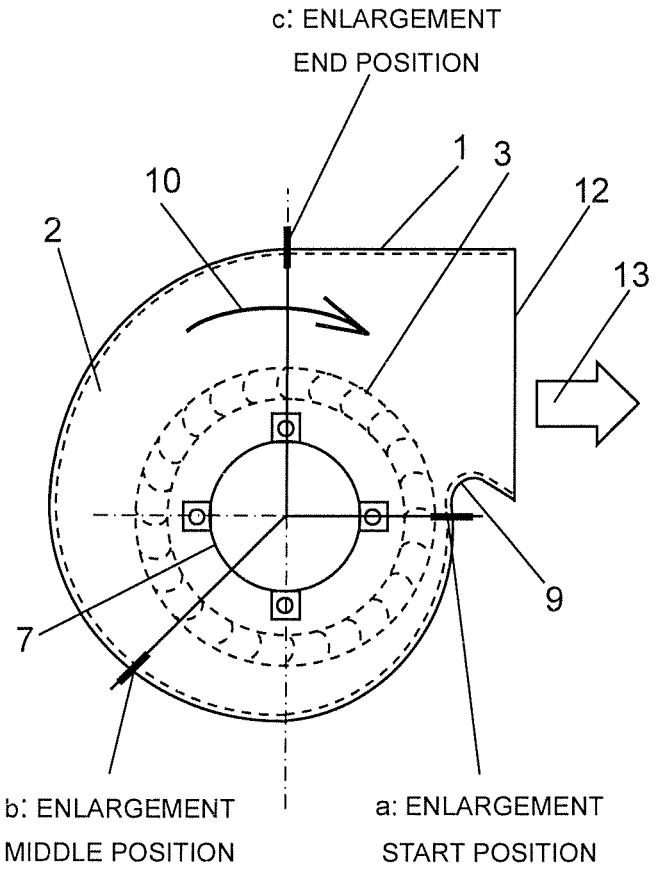
FIG. 3A is a side view of a different example of the same single suction type centrifugal fan.
Figure 3B:
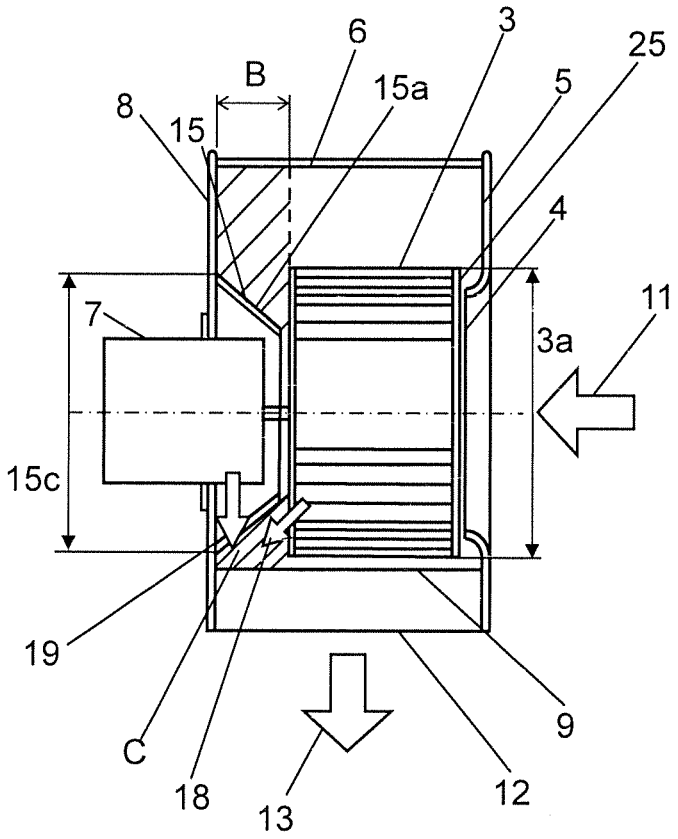
FIG. 3B is a cross-sectional view of the different example of the same single suction type centrifugal fan.

FIG. 3A is a side view of a different example of the single suction type centrifugal fan of the first exemplary embodiment of the present invention, and FIG. 3B is a cross-sectional view of the different example of the same single suction type centrifugal fan. As shown in FIG. 3B, second rectifying plate diameter 15*c* of rectifying plate 15 on the side of motor fixing side plate 8 may be the same size as impeller diameter 3*a*. A distance between tongue portion 9 and rectifying plate 15 is large on impeller 3 and gradually reduced toward motor fixing side plate 8. That is, a triangle opening continuing into casing 2 (region C) is formed.

As shown in FIGS. 3A and 3B, impeller discharge air flow 18 is blown out from impeller 3 in the vicinity of tongue portion 9 on discharge port 12 with respect to enlargement end position c, and flows to a side of motor 7. After that, impeller discharge air flow 18 passes through the opening formed between rectifying plate 15 and tongue portion 9 (region C), and flows into a part of region B in casing 2. A flow rate of impeller discharge air flow 18 is sufficiently reduced again in casing 2, the pressure is converted into the static pressure, and the impeller discharge air flow is blown out from discharge port 12.

Meanwhile, the gas flowing into the ventilation passage part (region B) in casing 2 circles along inclined surface 15*a*, the flow rate of the gas is sufficiently reduced, and the gas becomes ventilation passage discharge air flow 19 and is blown out from discharge port 12. That is, impeller discharge air flow 18 flowing out from impeller 3 in the vicinity of tongue portion 9 and ventilation passage discharge air flow 19 whose flow rate is sufficiently reduced in the ventilation passage part of region B are blown out from discharge port 12 without contact with each other.

It should be noted that in the present exemplary embodiment, the area of the cross section of rectifying plate 15 is successively reduced toward impeller 3. However, the area of the cross section may be reduced from a middle part between motor fixing side plate 8 and impeller 3.

In the first exemplary embodiment, the cross section orthogonal to rotation shaft 14 is the circle about rotation shaft 14. However, a center of the circle of this cross section may be displaced to a side of tongue portion 9. That is, by bringing the area of the flow passage cross section of scroll 6 close to enlargement start position a, the area of the flow passage cross section in region B is enlarged.

In the first exemplary embodiment, rectifying plate 15 is formed in a conical trapezoid shape in which the cross section orthogonal to rotation shaft 14 is a circle. However, this cross section may be an oval or an egg shape.

In such a way, with single suction type centrifugal fan 1 of the first exemplary embodiment of the present invention, the enlargement rate of the area of the flow passage cross section in the radial direction of impeller 3 is suppressed, and hence casing 2 is downsized. A shape of casing 2 is not complicated, and a decrease in performance (static pressure) is suppressed.

(Second Exemplary Embodiment)

Figure 4A:
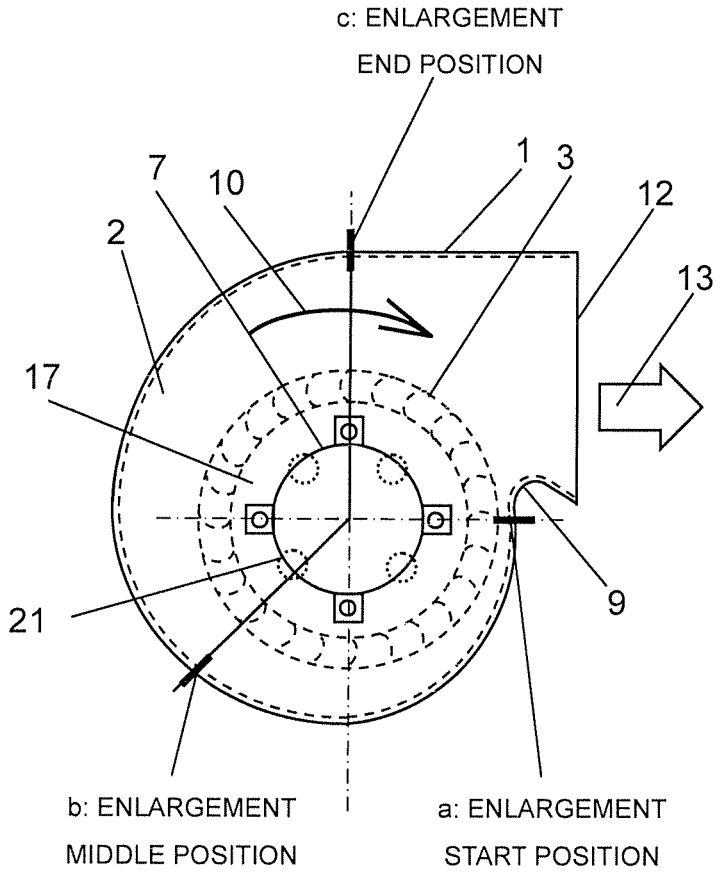
FIG. 4A is a side view of a single suction type centrifugal fan of a second exemplary embodiment of the present invention.

In a second exemplary embodiment of the present invention, the same constituent elements as those in the first exemplary embodiment will be given the same reference marks, detailed description of the constituent elements will be omitted, and only different points will be described. FIG. 4A is a side view of a single suction type centrifugal fan of the second exemplary embodiment of the present invention, and FIG. 4B is a front view of the same single suction type centrifugal fan.

Figure 4B:
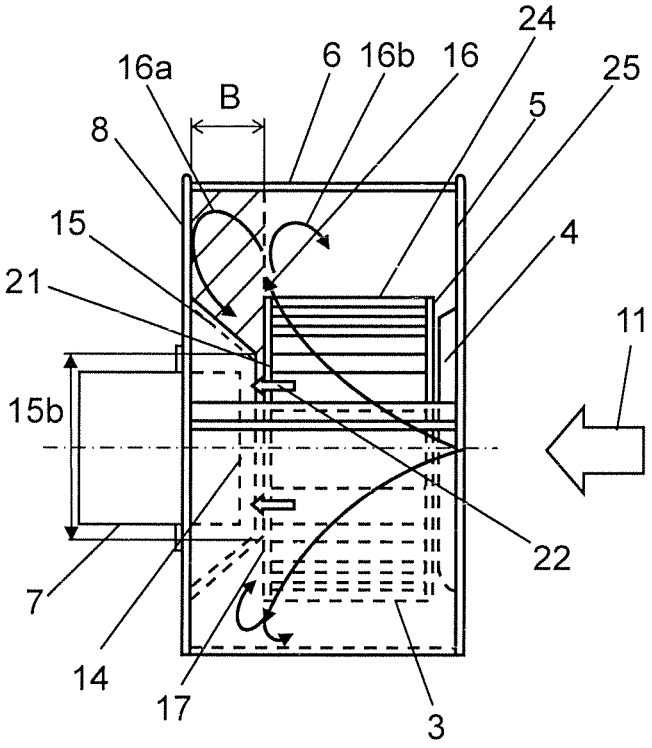
FIG. 4B is a front view of the same single suction type centrifugal fan.
Figure 5A:
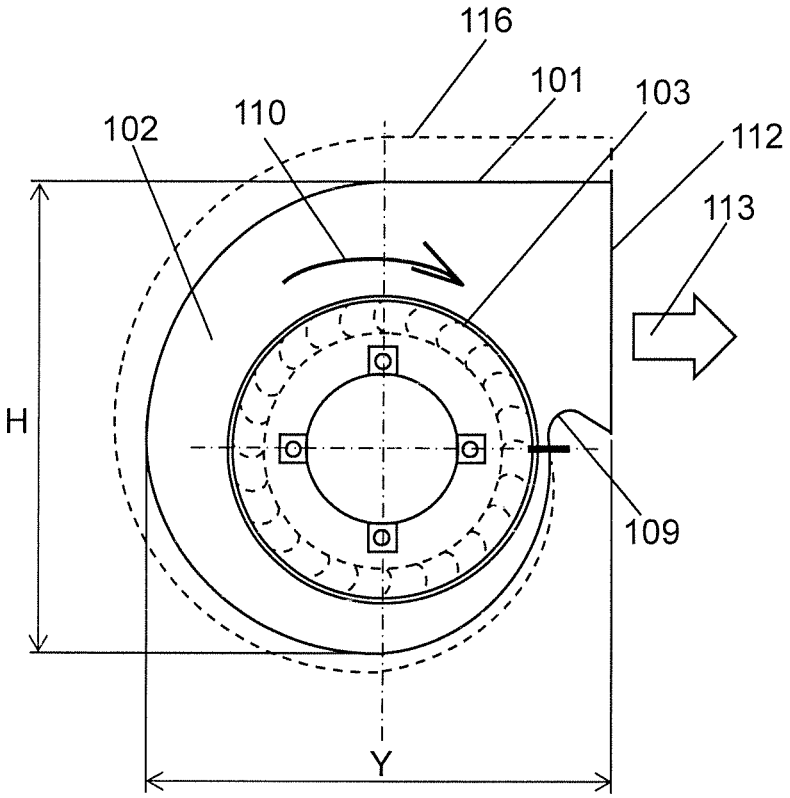
FIG. 5A is a side view of a conventional single suction type centrifugal fan.
Figure 5B:
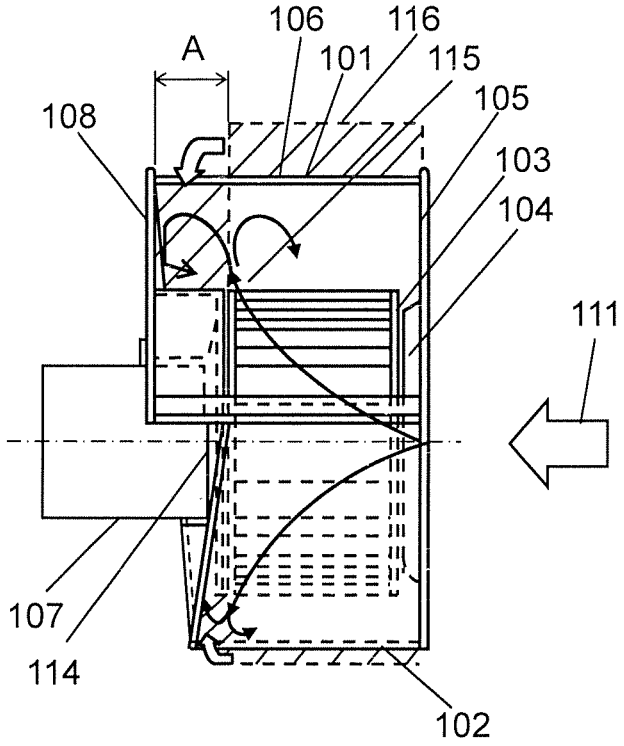
FIG. 5B is a front view of the same single suction type centrifugal fan.

As shown in FIGS. 4A and 4B, in single suction type centrifugal fan 1, several circular openings 21 are provided in main plate 17 of impeller 3. Openings 21 are provided within an area confined by first rectifying plate diameter 15*b* when rectifying plate 15 is projected onto main plate 17 along rotation shaft 14. Rectifying plate 15 located closer to impeller 3 is an opening end. That is, in rectifying plate 15 on the side of impeller 3, an interior of rectifying plate 15 (space on motor 7) and an exterior of rectifying plate 15 (space on impeller 3) communicate with each other.

Operations and effects of above single suction type centrifugal fan 1 will be described. Part of a gas flowing into impeller 3 from suction port 4 passes through openings 21 and flows into an inside of rectifying plate 15 (rectifying plate internal air flow 22). Rectifying plate internal air flow 22 reaches motor 7 disposed on the inside of rectifying plate 15 and cools motor 7 down. Therefore, a temperature increase of motor 7 is suppressed, and deterioration of bearing grease due to the temperature increase is suppressed.

It should be noted that in the second exemplary embodiment, openings 21 are formed in a circular shape. However, the openings may be formed in an oval or a polygon.

INDUSTRIAL APPLICABILITY

The single suction type centrifugal fan of the present invention can be applied to cooling of facilities and devices by air blow from a blow-out port of a machine in addition to a purpose of air conveyance of a ventilation fan device such as a duct fan, a ventilation fan device used in for example an air conditioner, and the like.

The invention claimed is:

1. A single suction type centrifugal fan comprising:
a casing including a scroll;
an impeller built in the casing; and
a motor fixed to the casing,
wherein the casing includes a side plate having a suction port, and a motor fixing side plate to which the motor is fixed so as to directly support the motor, the side plate and the motor fixing side plate being arranged in parallel,
wherein the impeller comprises:
a main plate fixed to a rotation shaft of the motor;
a plurality of blades fixed to the main plate; and
an auxiliary ring fixed to the plurality of blades,
wherein each of the plurality of blades being arranged parallel to the rotation shaft,
wherein a rectifying plate surrounding the rotation shaft in close proximity to the rotation shaft is provided between the motor fixing side plate and the main plate along a line parallel to the rotation shaft,
wherein the rectifying plate is formed of an inclined surface of which an area in a cross section orthogonal to the rotation shaft decreases toward the impeller,
wherein an entire body of the impeller is disposed at a side plate side of the rectifying plate,
wherein a first rectifying plate diameter at one side of the rectifying plate closer to the impeller is smaller than an impeller diameter of the impeller, and
wherein the motor fixing side plate is a flat plate.

2. The single suction type centrifugal fan according to claim 1, wherein a second rectifying plate diameter at another side of the rectifying plate closer to the motor fixing side plate is same as the impeller diameter.

3. The single suction type centrifugal fan according to claim 1, wherein the main plate has an opening provided within an area confined by the first rectifying plate diameter when the rectifying plate is projected onto the main plate along the rotation shaft.

4. The single suction type centrifugal fan according to claim 1, wherein a shape of the rectifying plate is a conical trapezoid shape.

5. The single suction type centrifugal fan according to claim 1, wherein a shape of the rectifying plate cross section orthogonal to the rotation shaft is one of an oval and an egg shape.

6. The single suction type centrifugal fan according to claim 1, wherein the motor fixing side plate extends to the motor.

7. A single suction type centrifugal fan comprising:
a casing including a scroll;
an impeller built in the casing; and
a motor fixed to the casing,
wherein the casing includes a side plate having a suction port, and a motor fixing side plate to which the motor is fixed, the side plate and the motor fixing side plate being arranged in parallel,
wherein the impeller comprises:
a main plate fixed to a rotation shaft of the motor;
a plurality of blades fixed to the main plate; and
an auxiliary ring fixed to the plurality of blades,
wherein each of the plurality of blades being arranged parallel to the rotation shaft,
wherein a rectifying plate surrounding the rotation shaft in close proximity to the rotation shaft is provided between the motor fixing side plate and the main plate,
wherein the rectifying plate is formed of an inclined surface of which an area in a cross section orthogonal to the rotation shaft decreases toward the impeller,
wherein an entire body of the impeller is disposed at a side plate side of the rectifying plate,
wherein a first rectifying plate diameter at one side of the rectifying plate closer to the impeller is smaller than an impeller diameter of the impeller, and
wherein a second rectifying plate diameter at another side of the rectifying plate closer to the motor fixing side plate is same as the impeller diameter.

8. A single suction type centrifugal fan comprising:
a casing including a scroll;
an impeller built in the casing; and
a motor fixed to the casing,
wherein the casing includes a side plate having a suction port, and a motor fixing side plate to which the motor is fixed, the side plate and the motor fixing side plate being arranged in parallel,
wherein the impeller comprises:
a main plate fixed to a rotation shaft of the motor;
a plurality of blades fixed to the main plate; and
an auxiliary ring fixed to the plurality of blades,
wherein each of the plurality of blades being arranged parallel to the rotation shaft,
wherein a rectifying plate surrounding the rotation shaft in close proximity to the rotation shaft is provided between the motor fixing side plate and the main plate,
wherein the rectifying plate is formed of an inclined surface of which an area in a cross section orthogonal to the rotation shaft decreases toward the impeller,
wherein an entire body of the impeller is disposed at a side plate side of the rectifying plate,
wherein a first rectifying plate diameter at one side of the rectifying plate closer to the impeller is smaller than an impeller diameter of the impeller, and
wherein a shape of the rectifying plate cross section orthogonal to the rotation shaft is one of an oval and an egg shape.

* * * * *